US005881881A

United States Patent [19]

Carrington

[11] Patent Number: 5,881,881

[45] Date of Patent: Mar. 16, 1999

[54] EVACUATEABLE BAG

[76] Inventor: Thomas Carrington, 4 DeRoy La., St. Charles, Mo. 63301

[21] Appl. No.: 876,578

[22] Filed: Jun. 16, 1997

[51] Int. Cl.[6] ..... B65D 81/20

[52] U.S. Cl. ..... 206/524.8; 383/3; 383/103

[58] Field of Search ..... 206/522, 524.8; 383/3, 41, 63, 101, 40, 103; 137/852, 855, 527

[56] References Cited

U.S. PATENT DOCUMENTS

| | | | |
|---|---|---|---|
| D. 338,399 | 8/1993 | Conte, Jr. | D9/305 |
| 3,980,226 | 9/1976 | Franz . | |
| 4,262,801 | 4/1981 | Avery | 206/522 |
| 4,310,118 | 1/1982 | Kisida et al. | 229/62.5 |
| 4,877,334 | 10/1989 | Cope . | |
| 5,113,599 | 5/1992 | Cohen et al. | 36/88 |
| 5,240,112 | 8/1993 | Newburger . | |
| 5,355,910 | 10/1994 | Gies et al. | 137/858 |
| 5,413,142 | 5/1995 | Johnson et al. | 137/515.5 |
| 5,578,083 | 11/1996 | Laguette et al. | 623/9 |

*Primary Examiner*—Paul T. Sewell
*Assistant Examiner*—Nhan T. Lam
*Attorney, Agent, or Firm*—Harpman & Harpman

[57] ABSTRACT

An evacuateable bag having a resealable access opening in which articles can be stored. The bag is made of thin flexible material with an air evacuation chamber located within. The evacuation chamber has reinforced resilient sidewalls with an inlet one-way valve in communication with the interior of the bag and an outlet one-way valve in communication with the atmosphere.

6 Claims, 3 Drawing Sheets

EVACUATEABLE BAG

BACKGROUND OF THE INVENTION

1. Technical Field

This device relates to flexible thin-walled containers that are used for storage that can be evacuated of ambient internal air to form a partial vacuum within. Containers of this type have one-way valves which upon closure can be used to withdraw the air using an auxiliary vacuum source.

2. Description of Prior Art

Prior art devices of this type have relied on a variety of different container configurations having large openings within which can be sealed. Vacuuming means are provided to allow for the connection of a vacuum pump or the like to withdraw the air from the interior of the container. Other examples of such evacuateable bags using oral means can be seen in U.S. Pat. Nos. 5,240,112, 4,877,334, and 3,980,226.

In U.S. Pat. No 5,240,112 an evacuateable bag can be seen having a large opening and an offset air stem and pinch valve which the user uses to remove the air after the bag is sealed by using his or her own lungs to create a vacuum.

In U.S. Pat. No. 4,877,334 a flexible bag is illustrated that can be inflated by use of an air pump.

In U.S. Pat. No. 3,980,226 is disclosed an evacuateable bag that has a large opening for the insertion of material to be stored. An air removal stem in connection with the interior of the bag is provided to allow the user to orally create a vacuum to remove the air from the container after the opening has been sealed.

SUMMARY OF THE INVENTION

A resealable bag of thin flexible material having an evacuation chamber included within for removing ambient air from the bag after it has been sealed. The chamber is integral with the bag's construction with a pair of one-way valves in communication with the bag's interior and to the atmosphere respectively. By repeatingly compressing and releasing the chamber, air is evacuated from the sealed bag.

DESCRIPTION OF THE PREFERRED EMBODIMENT

Figure 1:
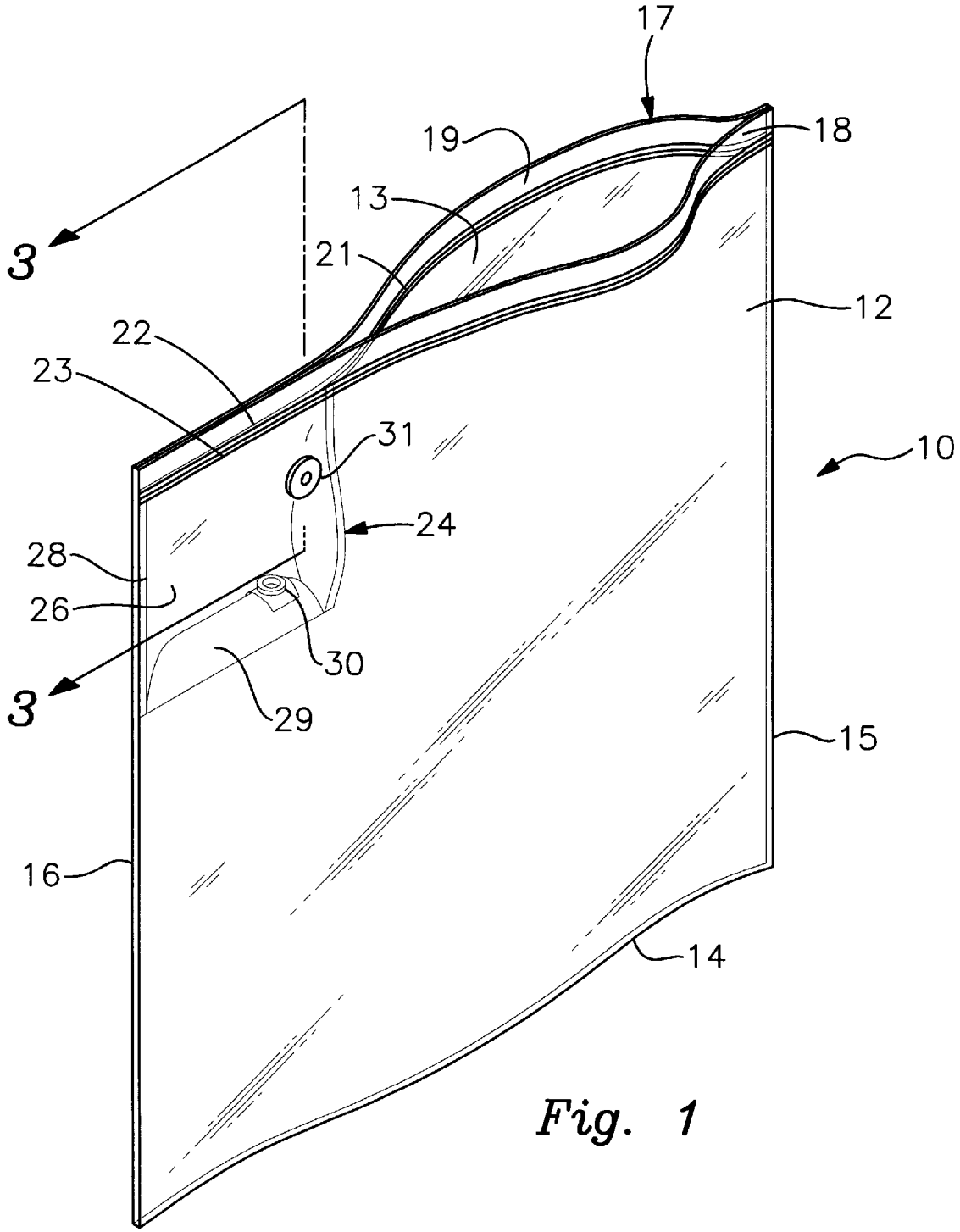
FIG. 1 is a perspective view of the bag comprising the invention.
Figure 2:
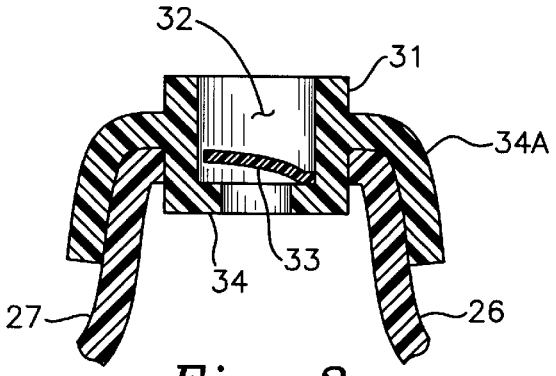
FIG. 2 is a side elevational view of the bag with a portion broken away illustrating the enclosed air removal chamber.

An evacuation bag 10 can be seen in FIGS. 1 and 2 of the drawings with a main enclosure having oppositely disposed front and back walls 12 and 13 defining a seamless bottom edge 14 and oppositely disposed seamed parallel side edges 15 and 16 of the respective front and back walls together defining a typical bag-like enclosure with an open top portion 17 as will be well understood by those skilled in the art.

The open top portion 17 has reinforcing bands 18 and 19 with respective interlocking sealing strips 21 extending across on the front wall 13 and is aligned for interlocking registration between spaced parallel registration strips 22 and 23 on the back wall 12 as will be well known and understood by those skilled in the art.

Figure 3A:
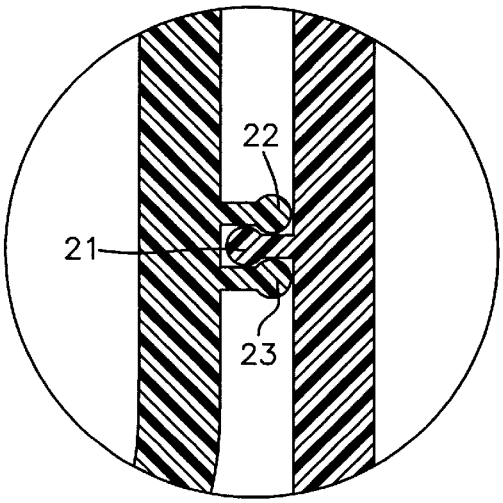
FIG. 3A is an enlarged detailed portion of an enlarged area shown in FIG. 3.
Figure 3:
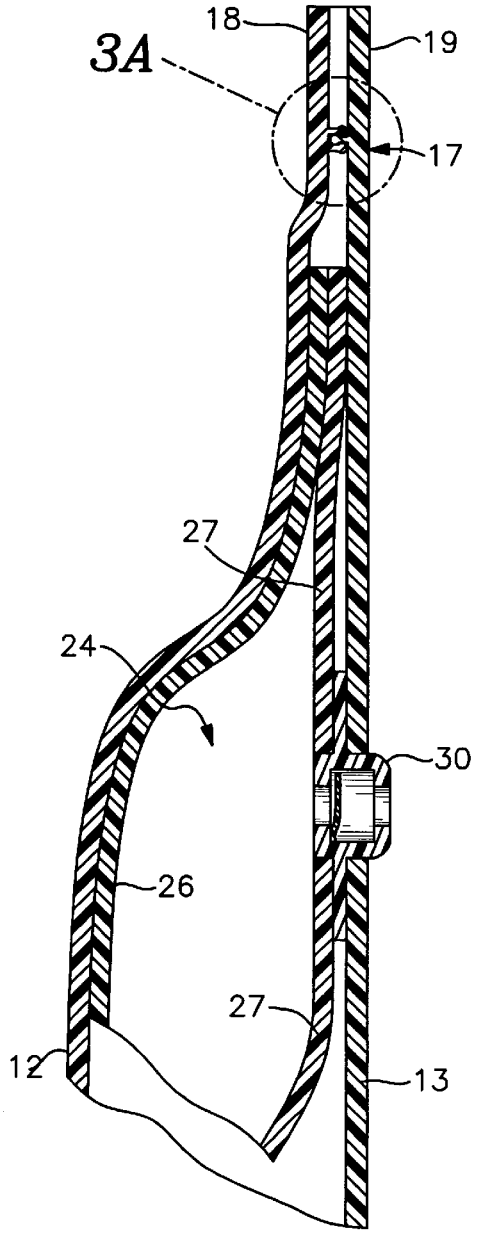
FIG. 3 is an enlarged cross-sectional view of a portion of the removal chamber within the bag.
Figure 5:
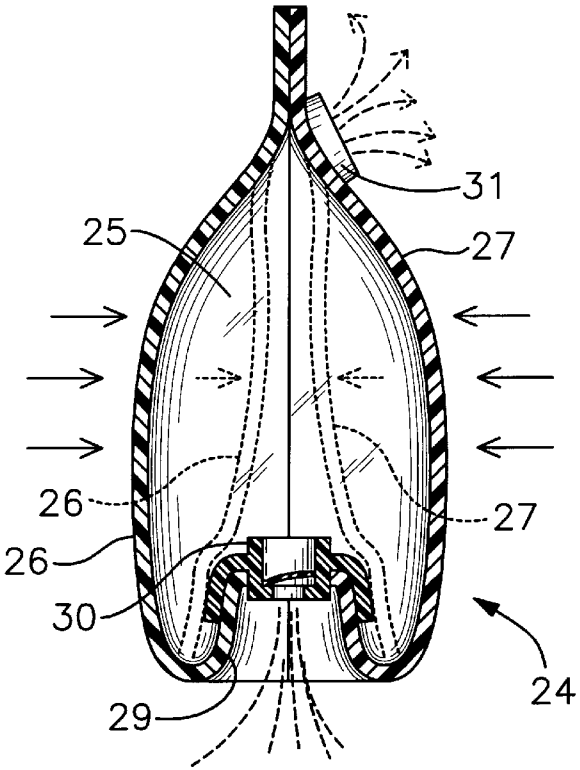
FIG. 5 is an enlarged cross-section on lines 5—5 of FIG. 4.
Figure 4:
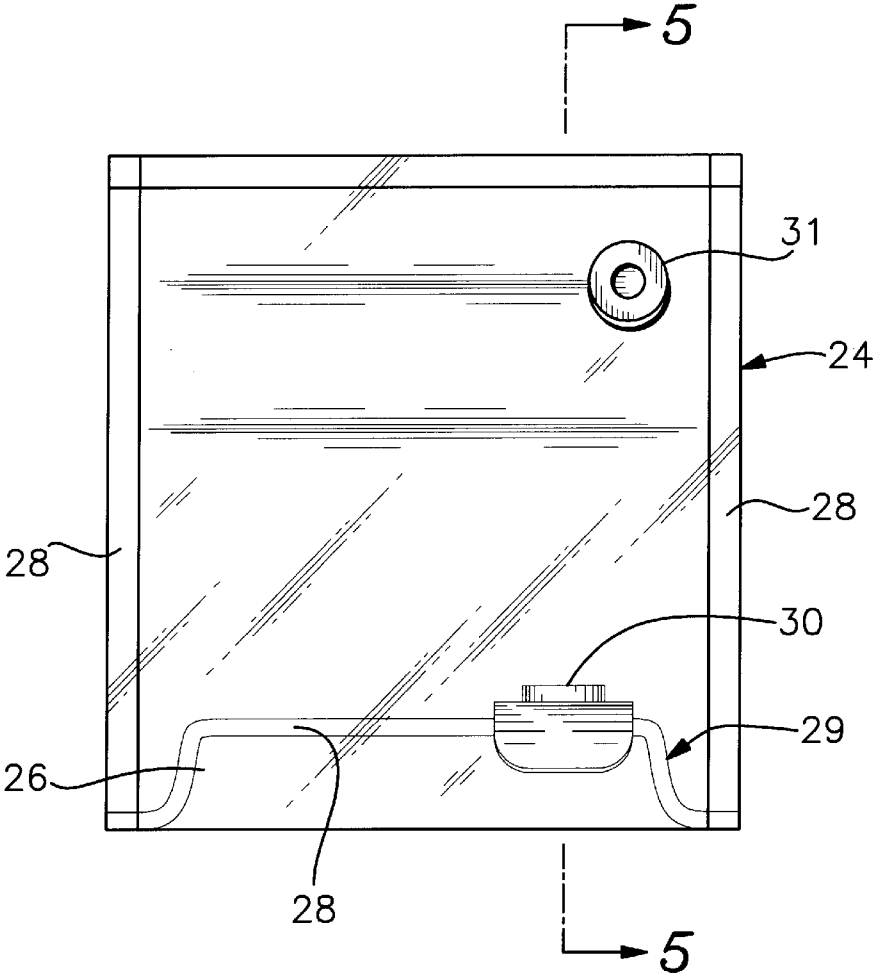
FIG. 4 is an enlarged side elevational view of the air removal chamber with portions broken away.

The subject of the invention is directed to an air pump chamber 24, best seen in FIGS. 3, 4 and 5 of the drawings, located within the bag enclosure adjacent its seamed side edge 16 and interengaging sealing strips 21–23, hereinbefore by disclosed.

The air pump chamber 24 defines an enclosure 25 having thick resilient walls 26 and 27 which are sealed together about their perimeter edge forming a flange 28 extending therefrom. A portion of the walls 26 and 27 have a semi-rigid central return inlet 29 formed within.

A first one-way valve element 30 is centered within the return inlet 29 so as to be recessed as in relation to the surrounding bag walls 12 and 13 defining an air passageway therebetween.

A second one-way valve 31 is positioned in the wall 27 and through the adjacent front wall 13 of the bag to atmosphere and is in spaced relation to said first valve 30 as best seen in FIG. 3 of the drawings. The air pump chamber 24 is secured to only the front wall 13 by its perimeter edge flange 28 allowing for full opening of the bag 10.

Referring now to FIG. 3 of the drawings, the first and second valves 30 and 31 each have an annular opening 32, a valve flap element 33 within and a registering valve seat 34 with a perimeter extending mounting flange 34A extending therefrom.

It will be evident that due to the related position of the flap valve elements 34 that they function as a true one-way valves with the first valve 30 in the air pump chamber 24 being in communication with the interior of the bag 10 defined by the walls 12 and 13 and sealed top 17. Conversely, the second valve 31 is in communication with the chamber's interior 25 venting to atmosphere through the sidewall 13.

In operation, it will be apparent that as the respective sidewalls 26 and 27 of the air chamber pump 24 are manually compressed as indicated in broken lines in FIG. 5 of the drawings by the user (not shown) the air within the air chamber 24 will be expelled through the one-way valve 31 to atmosphere while simultaneously sealing the valve element 30 preventing back flow into the bag 10. Conversely, once released the resilient walls 25 and 26 will expand to their original shape intaking air through the valve element 30 from the bag enclosure filling the air pump chamber 24 while effecting a seal in the valve element 31.

By sequential repeating of compression action on the air pump chamber 24 ambient air within the sealed bag will be evacuated as indicated by broken air flow arrows in FIG. 5 of the drawings creating a partial vacuum and collapse of the walls 12 and 13 together about any article, (not shown) stored within.

It will also be seen that by varying the relative size of the air chamber 24 to the proportional displacement of the bag 10 that efficient air evacuation bag can be made to any reasonable size scale and that by varying the relative size of the one-way valves 30 and 31, the most efficient air pump chamber 24 and be achieved.

It will thus be seen that a new and novel air evacuation bag has been illustrated and described and that various changes and modifications may be made therein without departing from the spirit of the invention.

Therefore I claim:

1. An evacuateable bag for providing a self-contained storage receptacle for articles comprising; a thin flexible plastic bag having a resealable open end, an independent air pump chamber positioned within said bag, a pair of valve elements in communication with said air pump chamber, said chamber having resilient walls seals about the perimeter edges, one of said valve elements secured to and extending through said bag communicating with atmosphere, said valve elements being of a one-way type.

2. The evacuateable bag of claim 1 wherein said bag's resealable open end comprises; an interlocking male and female sealing strips on respective oppositely disposed surfaces defining said open end.

3. The evacuateable bag of claim 1 wherein the air pump chamber has a contoured return inlet defined by said walls, one of said valve elements positioned within said return inlet.

4. The evacuateable bag of claim 3 wherein said resilient walls are in spaced relation to one another defining an air inlet and exhaust chamber therebetween at rest.

5. The evacuateable bag of claim 1 wherein said air pump chamber is positioned within said bag adjacent the resealable open end.

6. The evacuateable bag of claim 1 wherein said thin flexible plastic bag comprises; a seamless bottom edge, seam side edges defining a front and back walls, said air pump chamber secured to one of said walls and means for communication between said air pump chamber and said bag and said atmosphere.

* * * * *